US007380783B2

(12) United States Patent
Klein

(10) Patent No.: US 7,380,783 B2
(45) Date of Patent: Jun. 3, 2008

(54) APPARATUS PROVIDING REDUCTION IN MEDIA SKEW DURING A SHEET PICKING OPERATION

(75) Inventor: William Scott Klein, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 252 days.

(21) Appl. No.: 11/092,472

(22) Filed: Mar. 29, 2005

(65) Prior Publication Data

US 2006/0226592 A1 Oct. 12, 2006

(51) Int. Cl.
*B65H 3/06* (2006.01)

(52) U.S. Cl. ..... 271/117; 271/109

(58) Field of Classification Search ..... 271/121, 271/167, 109, 116, 117, 127
See application file for complete search history.

(56) References Cited

U.S. PATENT DOCUMENTS 3,724,839 A * 4/1973 Suzuki ..... 271/117
3,941,373 A * 3/1976 Stange ..... 271/124
4,465,363 A * 8/1984 Schmitt et al. ..... 399/348
4,744,687 A 5/1988 Nukaya et al.
4,831,397 A * 5/1989 Morse et al. ..... 396/387
4,978,113 A 12/1990 McAuley et al.
5,183,140 A 2/1993 Nicoll
5,435,537 A * 7/1995 Gysling ..... 271/10.05
5,437,444 A * 8/1995 Kawakami et al. ..... 271/22
5,480,247 A * 1/1996 Saikawa et al. ..... 400/629
5,648,808 A * 7/1997 Yanagi et al. ..... 347/104
5,697,716 A * 12/1997 Akahane ..... 400/624
5,810,492 A * 9/1998 Akahane et al. ..... 400/582
5,863,036 A * 1/1999 Tanaka et al. ..... 271/10.11
5,918,873 A * 7/1999 Saito et al. ..... 271/10.11
5,971,391 A * 10/1999 Salomon et al. ..... 271/153
6,009,302 A * 12/1999 Worley et al. ..... 399/367
6,142,467 A 11/2000 Funada
6,183,151 B1 * 2/2001 Kono ..... 400/582
6,352,256 B1 * 3/2002 Hsieh ..... 271/110
6,390,467 B1 5/2002 Fukube
6,640,079 B2 * 10/2003 Lim et al. ..... 399/345
6,877,735 B2 * 4/2005 Fujiwara ..... 271/117
2002/0074710 A1 * 6/2002 Sheng et al. ..... 271/109
2004/0007807 A1 * 1/2004 Fujiwara ..... 271/113
2004/0251593 A1 * 12/2004 Liu et al. ..... 271/109

* cited by examiner

*Primary Examiner*—Patrick Mackey
*Assistant Examiner*—Gerald W McClain
(74) *Attorney, Agent, or Firm*—Taylor & Aust, P.C.

(57) ABSTRACT

A media feeding apparatus includes a side wall, the side wall having a first side surface and an opposite side surface. A sheet picking mechanism has a pick arm and a pick roller. The pick arm is configured to mount the pick roller. The pick arm has a pivot axis substantially perpendicular to the side wall. A restraint is mounted to the pick arm, wherein at least the first side surface of the side wall is in close proximity to the restraint.

15 Claims, 4 Drawing Sheets

APPARATUS PROVIDING REDUCTION IN MEDIA SKEW DURING A SHEET PICKING OPERATION

BACKGROUND OF THE INVENTION

1. Field of the Invention

The present invention relates to imaging, and, more particularly, to an apparatus providing a reduction in media skew during a sheet picking operation.

2. Description of the Related Art

In an imaging apparatus, such as an ink jet printer or scanner, various methods and mechanisms are utilized to move media into an imaging zone for printing or scanning. One such sheet picking mechanism includes a pick arm free to pivot about a pivot axis, and a pick roller rotatably mounted to the pick arm for picking a media sheet from a supply tray. The pick arm includes a drive assembly, e.g., a driven gear and one or more idler gears, for driving the pick roller during a sheet picking operation. The choice of materials for construction and tolerance build-up between attached parts, such as between the pick arm and the associated pivot mounting feature, may allow this type of sheet picking mechanism to exhibit excessive motion out of the intended plane of action, thereby imparting an undesirable component of force to the media sheet being picked and causing it to skew rotationally. This skew results in improper placement of the media in the imaging zone. For example, in an ink jet printer, such skew during sheet picking may result in the image being skewed on the printed page.

What is needed in the art is an apparatus that reduces media skew during a sheet picking operation.

SUMMARY OF THE INVENTION

The present invention provides an apparatus that reduces media skew during a sheet picking operation.

The present invention, in one form thereof, is directed to a media feeding apparatus. The media feeding apparatus includes a side wall. The side wall has a first side surface and an opposite side surface. A sheet picking mechanism has a pick arm and a pick roller. The pick arm is configured to mount the pick roller. The pick arm has a pivot axis substantially perpendicular to the side wall. A restraint is mounted to the pick arm, wherein at least the first side surface of the side wall is in close proximity to the restraint.

The present invention, in another form thereof, is directed to a method for feeding a media sheet from a media supply tray with a sheet picking device, the sheet picking device having a pick arm and a sheet pick roller rotatably coupled to the pick arm. The method includes defining an intended plane of motion of the pick arm; and restraining the pick arm to movement substantially along the intended plane of motion.

The present invention, in another form thereof, is directed to an imaging apparatus. The imaging apparatus includes an imaging engine for performing an imaging operation with respect to a media sheet. A media tray holds the media sheet prior to the imaging operation. The media tray has a side wall, and the side wall has a first side surface and an opposite side surface. A sheet picking mechanism is provided for picking the media sheet from the media tray. The sheet picking mechanism has a pick arm, and the pick arm is configured for mounting a rotatable pick roller. A restraint is mounted to the pick arm. The restraint defines a first restraining feature and a second restraining feature, with a gap between the first restraining feature and the second restraining feature. The side wall of the media tray is positioned in the gap, wherein the first side surface faces the first restraining feature and the opposite side surface faces the second restraining feature.

An advantage of the present invention is that media skew during a sheet picking operation is reduced.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
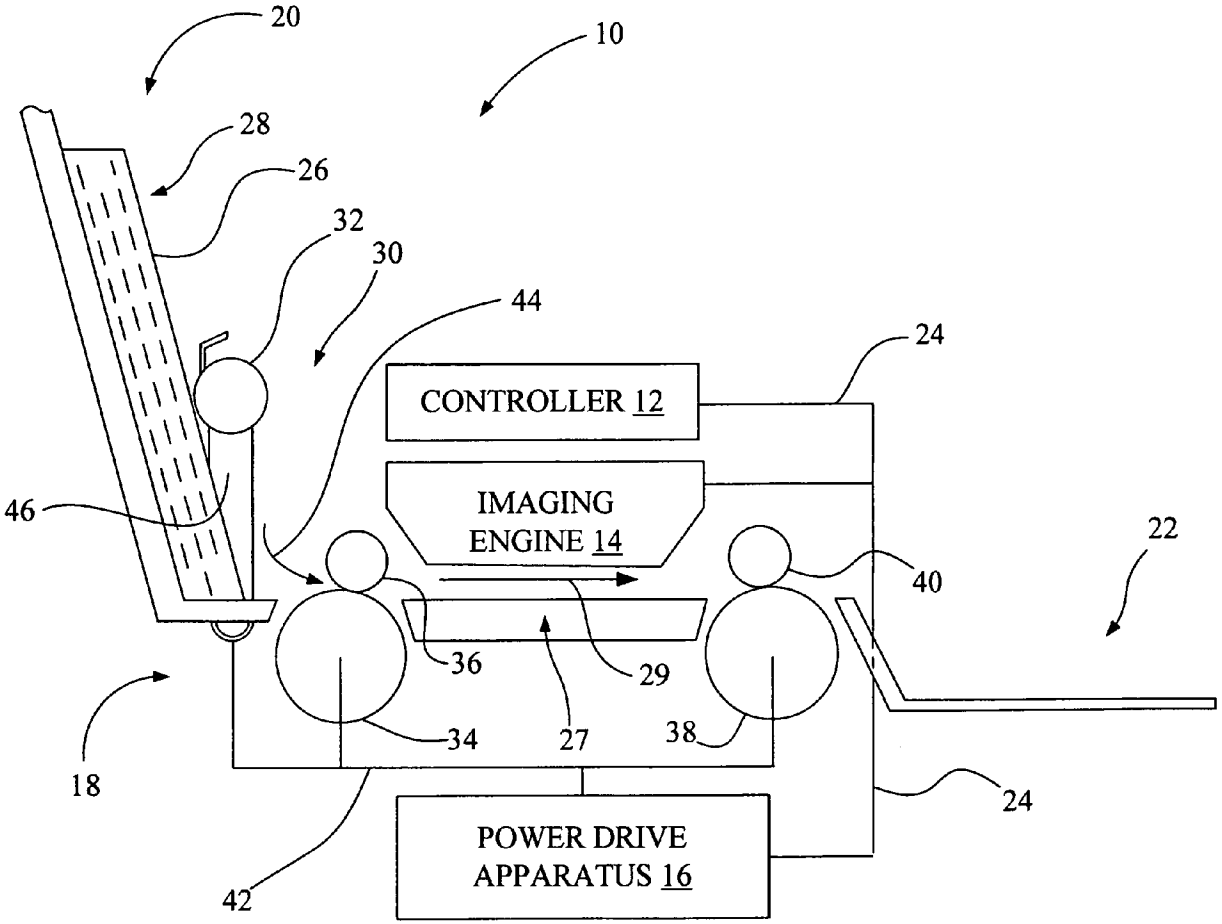
FIG. 1 is a diagrammatic representation of an imaging apparatus embodying the present invention.

Referring to FIG. 1, there is shown a diagrammatic representation of an imaging apparatus 10 embodying the present invention. Imaging apparatus 10 includes a controller 12, imaging engine 14, a power drive apparatus 16, a media transport system 18, a media supply tray 20 and a media exit tray 22. Controller 12 is communicatively coupled to each of media transport system 18 and imaging engine 14 via a communications link 24.

As used herein, the term "communications link" generally refers to structure that facilitates electronic communication between two or more components, and may operate using wired or wireless technology. Accordingly, communications link 24 may be, for example, one of, or a combination of, a bus structure, a direct electrical wired connection, a direct wireless connection (e.g., infrared or r.f.), or a network connection (wired or wireless), such as for example, an Ethernet local area network (LAN) or a wireless networking standard, such as IEEE 802.11.

Controller 12 may be, for example, an application specific integrated circuit (ASIC) having programmed and/or programmable processing capabilities. Controller 12 may include, for example, semiconductor memory, such as for example, random access memory (RAM), read only memory (ROM), and/or non-volatile RAM (NVRAM). Controller 12 may include in its memory a software or firmware program including program instructions that function as a driver for imaging engine 14.

Imaging engine 14 may be, for example, a print engine and/or a scanning device, depending on the type of mechanism and the configuration of imaging apparatus 10. For example, in one embodiment, imaging apparatus 10 may be an all-in-all (AIO) unit having printing and copying functionality in addition to scanning functionality. Accordingly, the driver, as a software or firmware program, executed by controller 12 may include a scanner driver subroutine for controlling a scanning device and for interpreting image data received from the scanner device of imaging engine 14, as well as a printer driver that places print data and print commands in a format that can be recognized by a print engine of imaging engine 14.

In embodiments where imaging engine includes a scanning device, the scanning device may operate using a stationary scan bar, or a moving scan bar, depending on the type of scanning desired or required for a particular scanning application. The scanning device may be, for example, either a CCD (Charge Coupled Device) array or CIS (Contact Image Sensors) array, implemented as image reduction systems or contact imaging systems. Some imaging apparatuses, for example, may utilize the same scanning bar to accommodate either a stationary scan bar implementation or a moving scan bar implementation. In implementations where a stationary scan bar is used, scanning occurs by processing the media sheet with media transport system 18 past the stationary scanner. In implementations where a moving scan bar is used, commonly called a flat bed scanner, the media sheet is typically transported to a stationary position on a document glass platen, and the media sheet is scanned by scanning the scan bar across the stationary media sheet. Further, in the flat bed type scanner, scanning may occur in the media feed direction, or alternatively, in a direction transverse to the media feed direction.

In embodiments where imaging apparatus 10 includes a print engine, the print engine may be, for example, a print engine of any type known in the art for producing a printed output corresponding to image data that is supplied thereto. Such a print engine may utilize one or more of ink jet technology, electrophotographic (e.g., laser) technology, dot matrix technology, or dye sublimation technology. As a more specific example, where imaging engine 14 includes an ink jet print engine, printing may be realized using a reciprocating printhead carrier that carries one or more ink jet printing heads, and operated under the control of controller 12.

Power drive apparatus 16 and media transport system 18 are used to transport a media sheet 26, such as a paper, transparencies, etc., from the stack of media sheets 28 held in media supply tray 20, to, through and from an imaging area 27 of imaging engine 14 to media exit tray 22 in a media feed direction 29.

Media transport system 18 includes a sheet picking device 30 having a pick roller 32; a feed roller set 34 and corresponding pinch roller set 36; and an exit roller set 38 and corresponding backup roller set 40. Power drive apparatus 16 is drivably coupled via a transmission device 42, diagrammatically illustrated by interconnected lines, to each of sheet picking device 30, feed roller set 34 and exit roller set 38.

Power drive apparatus 16 may include as a power source a motor, such as a direct current (DC) motor or a stepper motor. Transmission device 42 may be, for example, a set of gears and/or belts, and clutches configured to transmit a rotational force to the respective rollers at the appropriate time, in conjunction with commands supplied to power drive apparatus 16 from controller 12. Feed roller set 34 and exit roller set 38 may be drivably coupled together, for example, via a pulley/belt system or a gear train.

In the embodiment shown, media supply tray 20 combines with imaging engine 14 to define a media path 44, which in this embodiment defines an L-shaped media path through imaging apparatus 10. It is contemplated, however, that media supply tray 20 may be of other configurations, such as wherein media supply tray 20 is oriented substantially horizontally, such that media path 44 is defined as a substantially flat media path through imaging apparatus 10. As a further alternative, media supply tray 20 may be connected via a C-shaped paper path having additional rollers.

Sheet picking device 30 is configured to automatically pick a media sheet, such as media sheet 26, from the stack of media sheets 28 located in media supply tray 20, and is sometimes implemented in the art by a mechanism commonly referred to as an auto compensator pick device. Sheet picking device 30 includes a pick arm 46 containing a plurality of gears that are drivingly coupled to sheet pick roller 32. Further, sheet pick roller 32 is positioned by pick arm 46 to contact the top media sheet in the stack of media sheets 28 in media supply tray 20. Thus, a media feeding apparatus 48 is formed, at least in part, by media supply tray 20 and sheet picking device 30. The picked sheet is conveyed in media feed direction 29.

Figure 2:
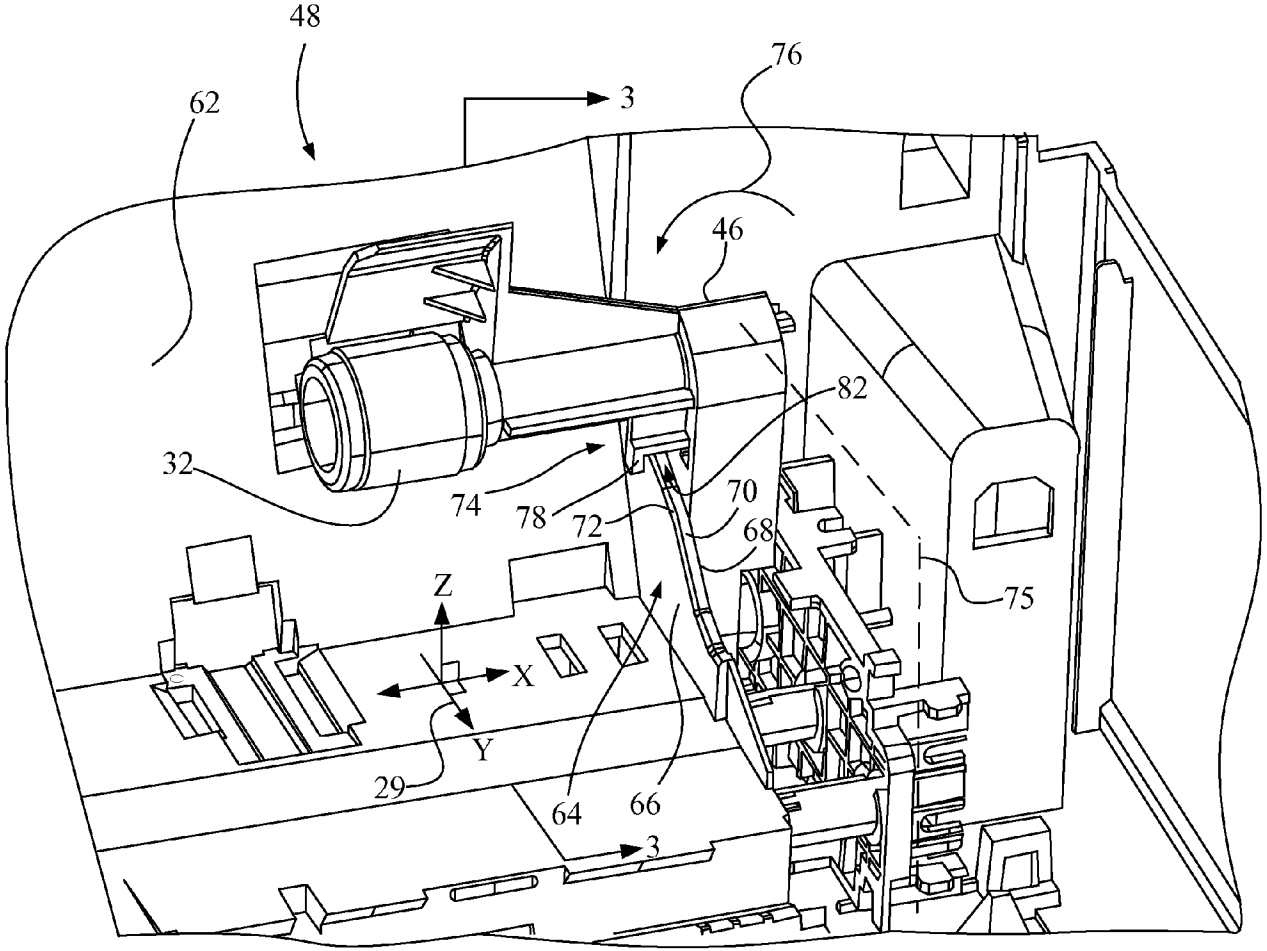
FIG. 2 is a perspective view of a portion of the imaging apparatus of FIG. 1, including a portion of a media feeding apparatus, viewed in a direction opposite the media feed direction.
Figure 3:
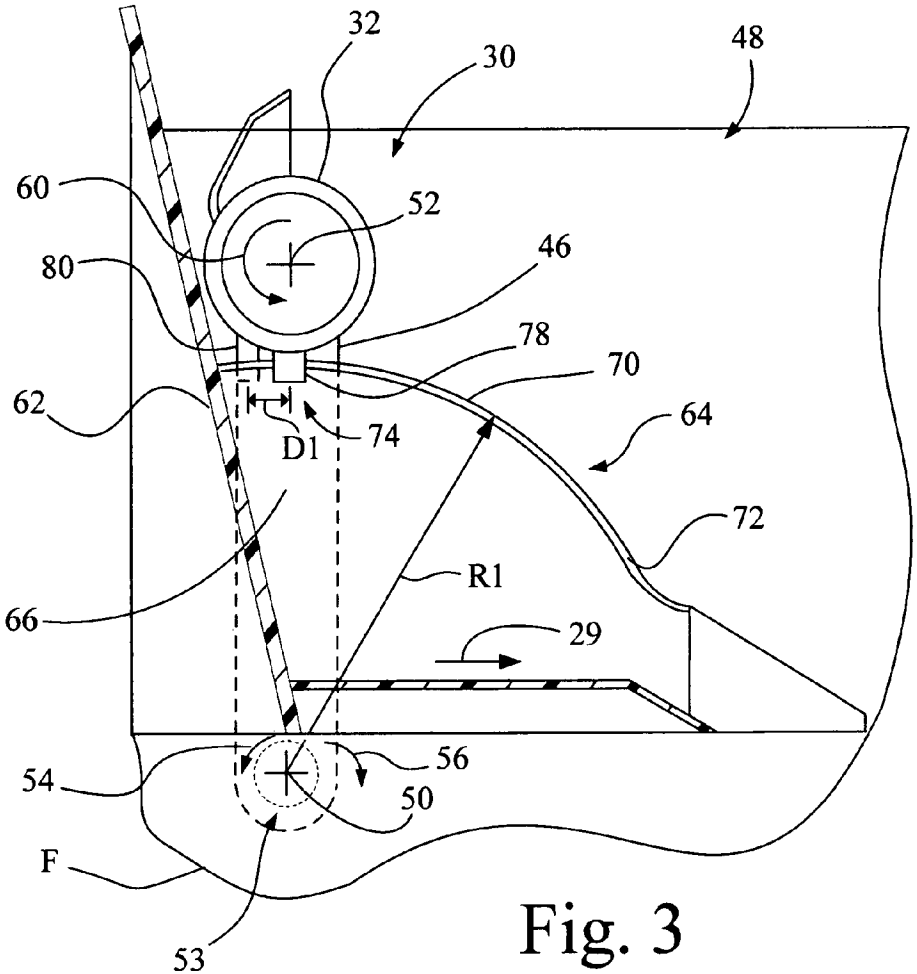
FIG. 3 is a side section view of the media feeding apparatus taken along line 3-3 of FIG. 2.
Figure 4:
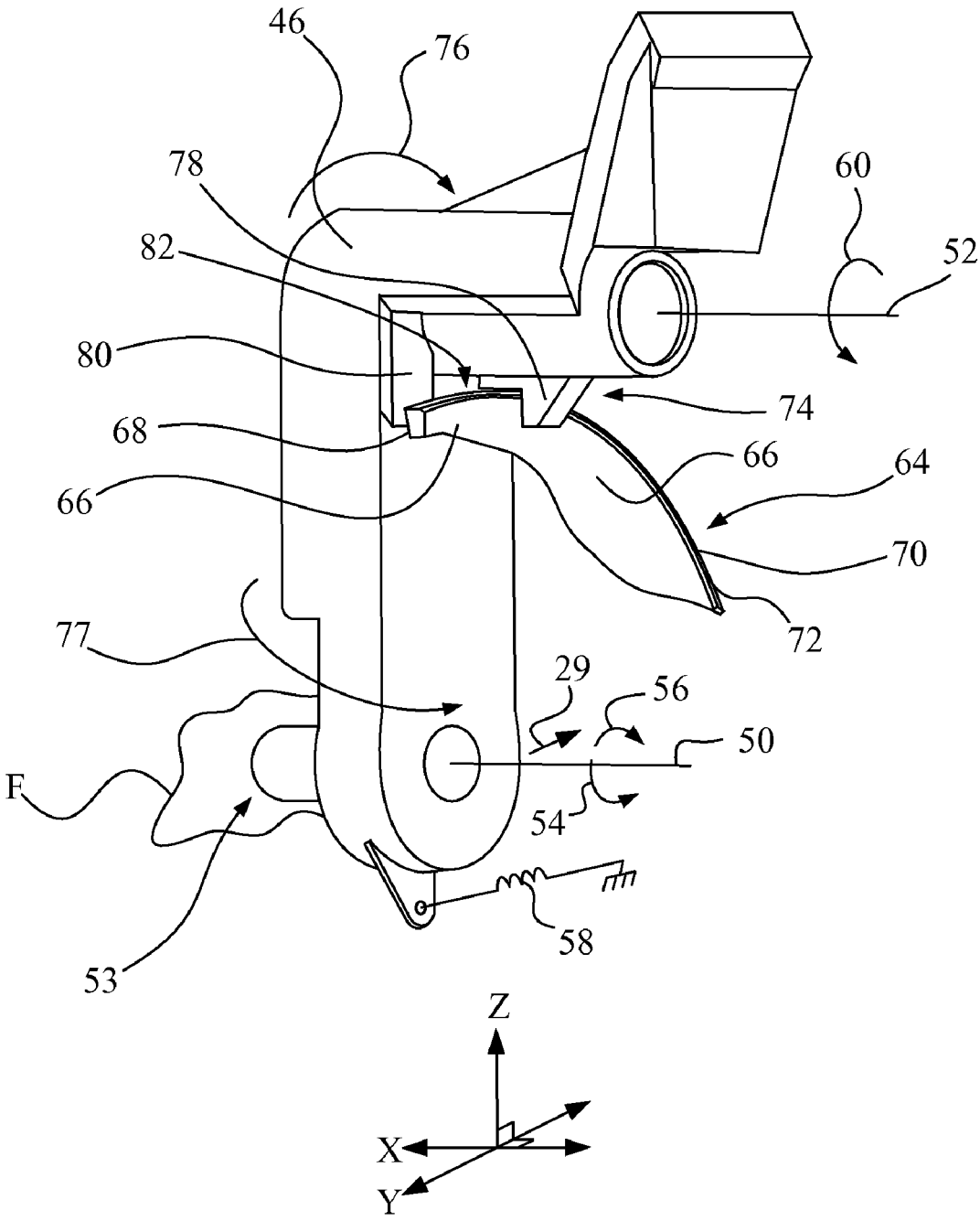
FIG. 4 is a perspective view of a broken out portion of the media feeding apparatus of FIG. 2, viewed in the media feed direction, with the pick roller removed from the pick arm for clarity.

In FIG. 2 there is shown a perspective view of a portion of imaging apparatus 10, including a portion of media feeding apparatus 48, viewed in a direction opposite media feed direction 29. FIG. 3 is a side sectioned view of media feeding apparatus 48 taken along line 3-3 of FIG. 2. FIG. 4 is a perspective view of a broken out portion of the media feeding apparatus 48 of FIG. 2, viewed generally in the media feed direction 29, and with pick roller 32 removed for clarity.

Referring to FIGS. 3 and 4, sheet picking device 30 includes a pivot axis 50 and a rotational axis 52. Pick arm 46 is pivotably coupled to a frame F of imaging apparatus 10 via a pivot arrangement 53, such as a shaft/bushing arrangement. Pivot axis 50 and rotational axis 52 are oriented so as to be spaced apart and parallel. Pick arm 46 may pivot in pivot directions 54 and 56 about pivot axis 50. Pick arm 46 is biased by a spring 58 in pivot direction 54. Pick arm 46 may be manually pivoted in pivot direction 56 during the loading of the stack of media sheets 28 is media supply tray 20. Pick roller 32 rotates in rotational direction 60 about rotational axis 52 during a sheet picking operation.

Media supply tray 20 includes a rear wall 62 and a side wall 64. Side wall 64 has a first side surface 66 and an opposite side surface 68. Rear wall 62 supports a media surface of the bottom sheet of the stack of media sheets 28. First side surface 66 of side wall 64 may function as a media guide for the stack of media sheets 28, and, in the orientation of components shown in FIG. 2, functions as a right edge media guide. In accordance with an embodiment of the present invention, side wall 64 is formed at a radius, R1, (see FIG. 3) with respect to pivot axis 50 of sheet picking device 30, defining a radial perimeter 70. Along radial perimeter 70 of side wall 64 there is formed a beveled surface 72. Radial perimeter 70 is sized to accommodate a range of motion of pick arm 46 along a plane of side wall 64.

A restraint 74 is mounted to pick arm 46, at a distance relative to radius R1 from pivot axis 50, for receiving a portion of side wall 64 of media supply tray 20. In one embodiment, for example, restraint 74 is formed integral with pick arm 46.

Ideally, pivot axis 50 of pick arm 46 is perpendicular to first side surface 66 of side wall 64, such that the intended plane of motion 75 of pick arm 46 is substantially parallel to the plane of side wall 64, e.g., extending parallel to media feed direction 29. However, due to component tolerances associated with sheet picking device 30, such as the pivotal coupling of pick arm 46 with the frame F of imaging apparatus 10 via pivot arrangement 53, e.g., a shaft/bushing arrangement, the engagement of pick roller 32 with the media sheet during a sheet picking operation may cause one or more torque forces to be applied to pick arm 46, such as in directions 76 and/or 77 (see FIGS. 2 and 4), wherein in the absence of restraint 74 the actual plane of motion associated with pick arm 46 would deviate from the intended plane of motion 75 of pick arm 46. In order to limit the effect of this torque action on sheet picking device 30 during the sheet picking operation, and in turn to reduce media skew resulting from this torque action during the sheet picking operation, restraint 74 is configured and located to interact with side wall 64 so as to reduce the amount of rotational displacement of pick arm 46 with respect to the intended plane of motion 75, and in turn, with respect to the plane of side wall 64.

Restraint 74 includes a first restraining feature 78 and a second restraining feature 80. As can be best seen in FIGS. 2 and 4, a gap 82 is formed between first restraining feature 78 and second restraining feature 80. As such, side wall 64 of media supply tray 20, including radial perimeter 70 and beveled surface 72, is positioned in gap 82, wherein first side surface 66 of side wall 64 faces first restraining feature 78 and opposite side surface 68 of side wall 64 faces second restraining feature 80. Beveled surface 72 aids in the insertion of side wall 64 into gap 82.

Referring to FIG. 3, first restraining feature 78 and second restraining feature 80 are spaced, i.e., staggered, along the plane of side wall 64 by a distance D1, and more particularly, is staggered along radial perimeter 70 by distance D1. Distance D1 is shown for convenience at locations along the central regions of first restraining feature 78 and second restraining feature 80. While the distance D1 is limited by practical considerations, in general, the larger the distance D1 the less the amount of rotational displacement of pick arm 46 with respect to the plane of side wall 64 and the intended plane of motion 75.

Clearances between restrain 74 and side wall 64 are selected so as to permit a freedom of motion pick arm 46 along the intended plane of motion 75, while substantially limiting the freedom of motion of pick arm 46 to that of the intended plane of motion 75, e.g., substantially parallel to the plane of side wall 64. For example, in the configuration of restraint 74 in accordance with one exemplary embodiment, first side surface 66 of side wall 64 is in close proximity to first restraining feature 78 of restraint 74, and opposite side surface 68 of side wall 64 is in close proximity to second restraining feature 80 of restraint 74, wherein side wall 64 at times may touch one or both of restraining features 78, 80 during a sheet picking operation without binding within gap 82 of sheet picking device 30.

While this invention has been described with respect to exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A media feeding apparatus, comprising:

a side wall, said side wall having a first side surface and an opposite side surface;

a sheet picking mechanism having a pick arm and a pick roller, said pick arm being configured to mount said pick roller, said pick arm having a pivot axis substantially perpendicular to said side wall; and a restraint mounted to said pick arm, wherein at least said first side surface of said side wall is in close proximity to said restraint, said restraint having a first restraining feature and a second restraining feature, with a gap located between said first restraining feature and said second restraining feature, and wherein said first side surface faces said first restraining feature and said opposite side surface faces said second restraining feature.

2. The media feeding apparatus of claim 1, wherein said first restraining feature and said second restraining feature are spaced along a plane of said side wall.

3. The media feeding apparatus of claim 2, wherein said pick arm has a range of motion along a plane substantially parallel to said plane of said side wall.

4. The media feeding apparatus of claim 1, wherein said side wall forms an edge guide of a media tray.

5. The media feeding apparatus of claim 1, further comprising a beveled surface located at a perimeter of said first side surface of said side wall.

6. An imaging apparatus, comprising:

an imaging engine for performing an imaging operation with respect to a media sheet;

a media tray for holding said media sheet prior to said imaging operation, said media tray having a side wall, said side wall having a first side surface and an opposite side surface;

a sheet picking mechanism for picking said media sheet from said media tray, said sheet picking mechanism having a pick arm, said pick arm being configured for mounting a rotatable pick roller; and a restraint mounted to said pick arm, said restraint having a first restraining feature and a second restraining feature, with a gap between said first restraining feature and said second restraining feature, said side wall of said media tray being positioned in said gap, wherein said first side surface faces said first restraining feature and said opposite side surface faces said second restraining feature.

7. The imaging apparatus of claim 6, said pick arm having a pivot axis positioned substantially perpendicular to said side wall of said media tray.

8. The imaging apparatus of claim 6, wherein said first restraining feature and said second restraining feature are staggered along a plane of said side wall.

9. The imaging apparatus of claim 8, wherein said side wall has a radial perimeter to accommodate a range of motion of said pick arm.

10. The imaging apparatus of claim 8, wherein said pick arm has a range of motion along a plane substantially parallel to said plane of said side wall.

11. The imaging apparatus of claim 6, wherein said side wall forms an edge guide of said media tray.

12. The imaging apparatus of claim 6, further comprising a beveled surface located at a perimeter of said first side surface of said side wall.

13. The imaging apparatus of claim 6, wherein said imaging engine is a print engine.

14. The imaging apparatus of claim 6, wherein said imaging engine is a scanning device.

15. A method for feeding a media sheet from a media supply tray with a sheet picking device, said sheet picking device having a pick arm and a sheet pick roller rotatably coupled to said pick arm, the method comprising:

establishing an intended plane of motion of said pick arm to which said sheet pick roller is rotatably coupled, said sheet pick roller moving with said pick arm when said pick arm is moved along said intended plane of motion; and restraining said pick arm to movement substantially along said intended plane of motion, wherein said restraining includes:

forming a first restraining feature on said pick arm and a second restraining feature on said pick arm, with a gap between said first restraining feature and said second restraining feature; and positioning a side wall of said media supply tray in said gap wherein a first side surface of said side wall faces said first restraining feature and an opposite side surface of said side wall faces said second restraining feature.

* * * * *